US008850751B2

(12) United States Patent
Makin

(10) Patent No.: US 8,850,751 B2
(45) Date of Patent: Oct. 7, 2014

(54) ROOF EDGING DEVICE

(76) Inventor: Stephen John Makin, Weymouth (GB)

( * ) Notice: Subject to any disclaimer, the term of this patent is extended or adjusted under 35 U.S.C. 154(b) by 109 days.

(21) Appl. No.: 13/062,506

(22) PCT Filed: Sep. 7, 2009

(86) PCT No.: PCT/GB2009/002137

§ 371 (c)(1),
(2), (4) Date: Apr. 27, 2011

(87) PCT Pub. No.: WO2010/026392

PCT Pub. Date: Mar. 11, 2010

(65) Prior Publication Data

US 2012/0110924 A1 May 10, 2012

(30) Foreign Application Priority Data

Sep. 6, 2008 (GB) ..... 0816261.2

(51) Int. Cl.
*E04D 13/15* (2006.01)
*E04D 13/147* (2006.01)
*E04D 13/158* (2006.01)

(52) U.S. Cl.
CPC ..... *E04D 13/1585* (2013.01); *E04D 13/1478* (2013.01)
USPC ..... 52/94; 52/58

(58) Field of Classification Search
CPC ..... E04D 1/36; E04D 1/38; E04D 13/15; E04D 13/158; E04D 13/0459
USPC ..... 52/58, 60, 94, 96, 97, 556, 716.2
See application file for complete search history.

(56) References Cited

U.S. PATENT DOCUMENTS

| | | | | | |
|---|---|---|---|---|---|
| 3,188,772 | A * | 6/1965 | Tennison, Jr. | 52/95 |
| 3,922,824 | A * | 12/1975 | Izawa et al. | 52/94 |
| 4,332,117 | A * | 6/1982 | Quinnell | 52/94 |
| 4,527,368 | A * | 7/1985 | Jentoft | 52/200 |
| 4,703,592 | A * | 11/1987 | Sampson et al. | 52/20 |
| 4,706,421 | A * | 11/1987 | Thompson | 52/94 |
| 6,035,587 | A * | 3/2000 | Dressler | 52/97 |
| 6,725,617 | B2 * | 4/2004 | Cox | 52/408 |
| 2005/0011140 | A1 * | 1/2005 | Ackerman et al. | 52/58 |
| 2007/0193126 | A1 * | 8/2007 | Teodorovich | 52/58 |

FOREIGN PATENT DOCUMENTS

| | | | |
|---|---|---|---|
| DE | 1256392 | B | 12/1967 |
| DE | 7341034 | U | 2/1974 |
| DE | 2905599 | A1 | 8/1980 |
| DE | 20318347 | U1 | 2/2004 |
| GB | 434730 | A | 9/1935 |

(Continued)

OTHER PUBLICATIONS

European Search Report dated Nov. 25, 2009.

(Continued)

*Primary Examiner* — Christine T Cajilig
(74) *Attorney, Agent, or Firm* — Symbus Law Group, LLC; Clifford D. Hyra

(57) ABSTRACT

A roof edge device (10) comprises a plastics strip (12) for location under the edge of a tiled/slated roof. A plurality of integral webs (2 and 3) extend from one side of the strip, at least one of said webs (2, 3) being for engagement with the underneath of the edge of the tiles/slates.

10 Claims, 6 Drawing Sheets

(56) References Cited

FOREIGN PATENT DOCUMENTS

| | | | | | |
|---|---|---|---|---|---|
| GB | 1158911 | A | | 7/1969 | |
| GB | 2164369 | A | * | 3/1986 | ..... E04D 13/15 |
| GB | 2171124 | A | * | 8/1986 | ..... E04D 13/14 |
| GB | 2353051 | A | | 2/2001 | |
| GB | 2383806 | A | | 7/2003 | |
| GB | 2401615 | A | | 11/2004 | |
| GB | 2413806 | A | | 11/2005 | |
| GB | 2454368 | A | | 5/2009 | |
| JP | 06073857 | A | * | 3/1994 | ..... E04D 13/15 |

OTHER PUBLICATIONS

International Search Report dated Jul. 4, 2010.

* cited by examiner

FIG. 4A
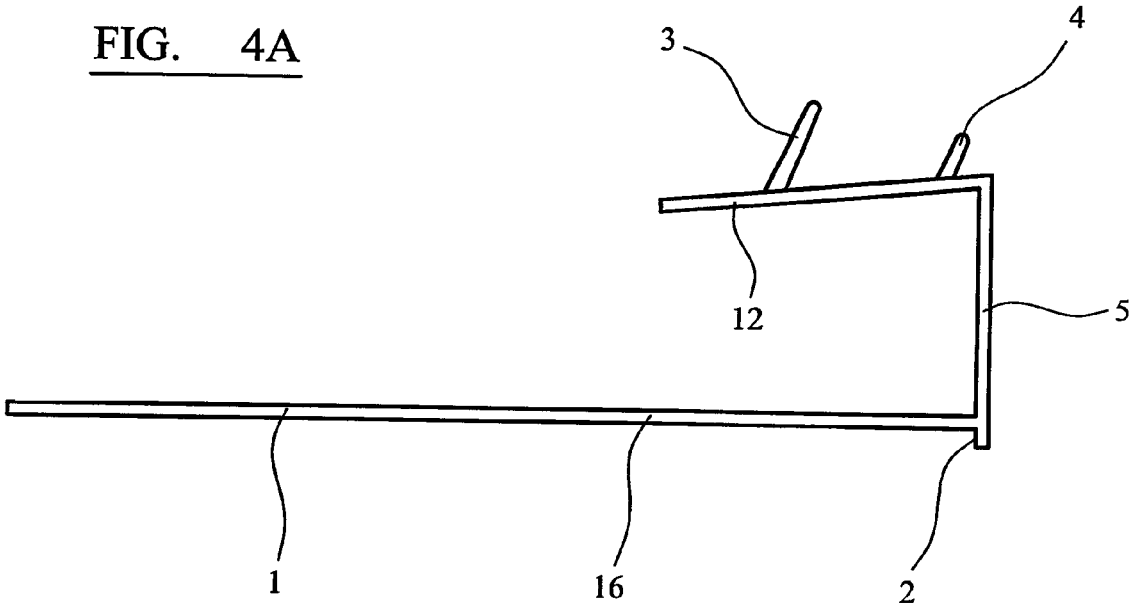
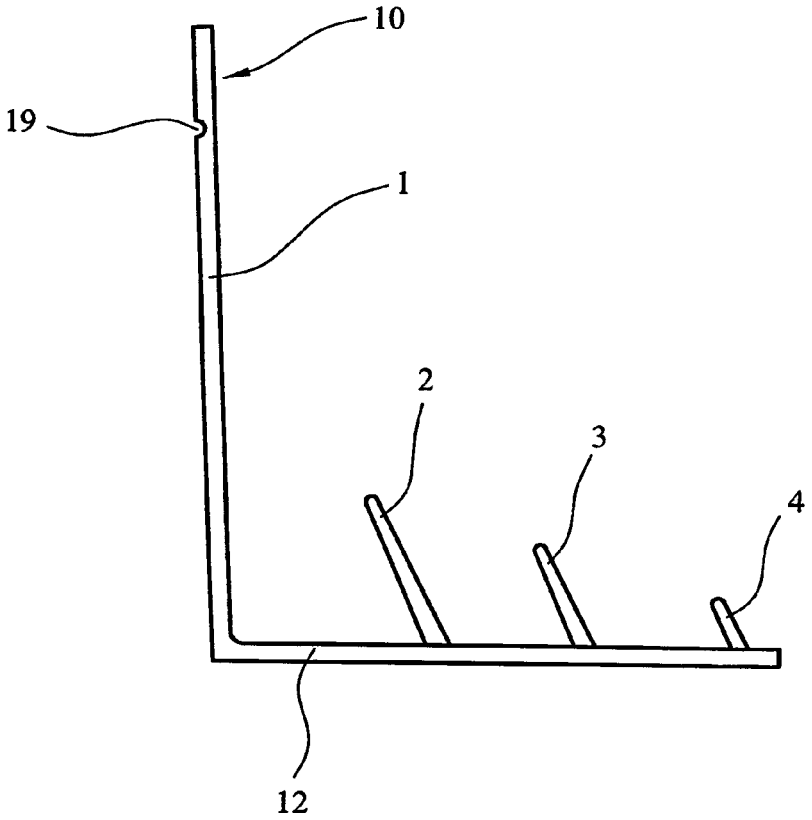
FIG. 10A

ROOF EDGING DEVICE

This application claims the benefit of United Kingdom patent application No. GB 08 16 261.2, filed Sep. 6, 2008, which is hereby incorporated by reference in its entirety.

FIELD OF THE INVENTION

This invention relates to roof edging devices and particularly for use where a roof meets a side wall.

BACKGROUND TO THE INVENTION

In countries such as the UK there are various constructional arrangements where the roof meets a side wall. In the case of the verge of a roof point, where the roof covering meets the side wall (gable triangle), running from the bottom (eaves) to the top (ridge), various methods have been used including the use of stone under-cloaking or ornate timber (barge boards) but these can be expensive.

An abutment of a roof is the point where the roof covering meets the side wall but rises above the roof. Traditionally this has been dealt with using lead sheet that is very expensive.

STATEMENTS OF THE INVENTION

According to the present invention there is provided a roof edging device comprising a plastics strip for location under the edge of a tiled/slated roof and a plurality of integral webs upstanding on one side from said strip, at least one of said webs being for engagement with the underneath of the edge of the tiles/slates.

In one embodiment of the present invention, one of said webs will, in use, extend alongside the edge of the tiles/slates. Preferably, a plurality of webs extend upwardly from said strip and are located, in use, below the tiles/slates.

In another embodiment, the strip forms part of a channel extending on that side of the strip opposite said webs, the channel being for accommodating the edge of roofing battens.

BRIEF DESCRIPTION OF THE DRAWINGS

The accompanying drawings are as follows:

FIG. 4A is a cross-section of a third embodiment of the invention;

FIG. 10A is a cross-section of a seventh embodiment of the present invention.

DETAILED DESCRIPTION OF THE INVENTION

Embodiments of the present invention will now be described, by way of examples only, with reference to the accompanying drawings.

Figure 1:
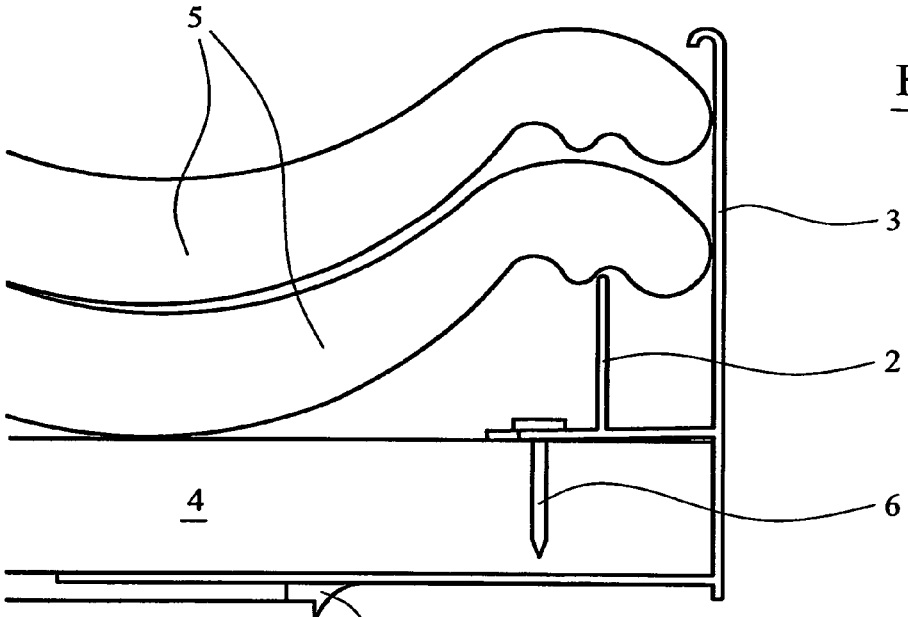
FIG. 1 is a section through a roof verge with profiled tiles and incorporating the device of the present invention.
Figure 2:
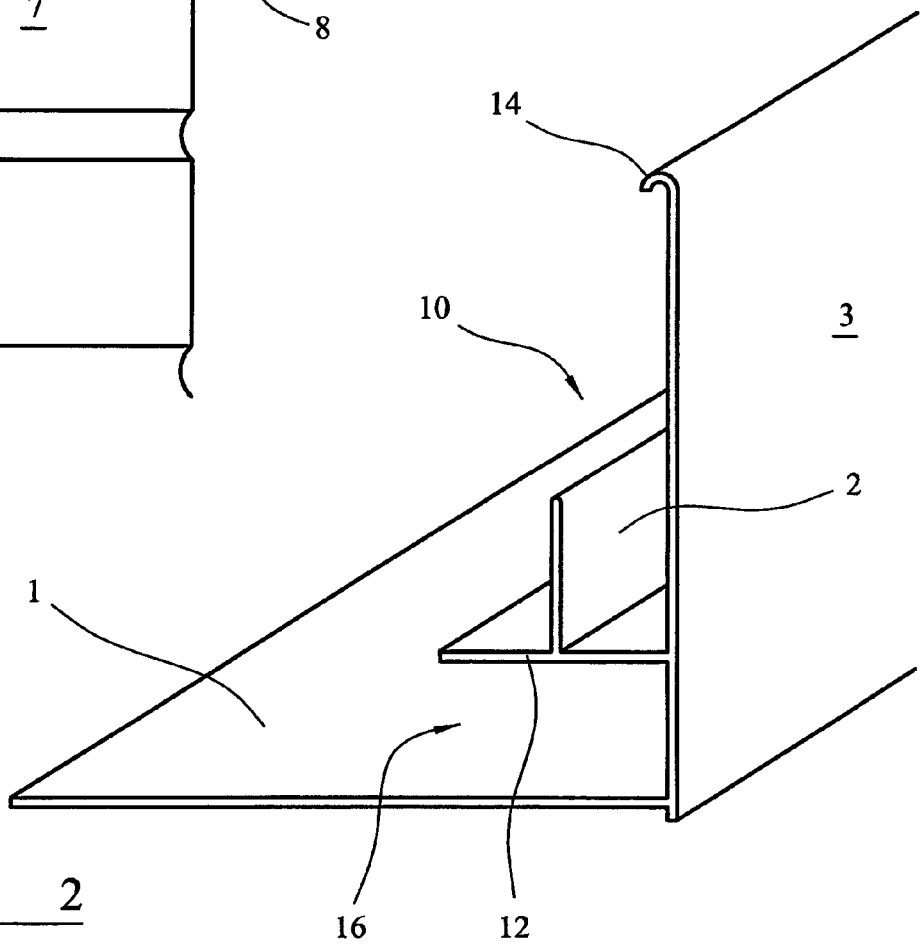
FIG. 2 shows the device used in FIG. 1.

Referring to FIGS. 1 and 2 of the accompanying drawings, a roof edging device 10 of the present invention comprises a plastics strip 12 having upstanding from a substantially central position of one edge a longitudinal web 2 which is made of a flexible rubber or rubber-like material and may, for example, have a height of about 30 mm.

Upstanding from one longitudinal edge of strip 11, on the same side as web 2 is a further web or verge face 3 which has a turned over upper edge 14 and which also extends downwardly below strip 12 as illustrated.

Extending horizontally (as shown) from a position close to the bottom edge of verge face 3 is a strip 1 which is an overhang or undercloak and which, together with strip 12 and verge face 3, forms a channel at 16.

The device 10 is a co-extruded PVC strip available in various colours. It can be used for many types of roof covering but is ideally suited to non-slate coverings with an individual thickness in excess of 10 mm (concrete and clay tiles such as tiles 5 shown in FIG. 1). The device can be used directly over brickwork 7 or finished timber as well as with many other styles and substrates. The device provides a quick, cost-effective and simple solution to installing a finished verge edge to a slate covered roof.

In order to fit the device 10 to achieve the arrangement shown in FIG. 1, the roof is first provided with felt and battens in the traditional way, allowing the battens 4 to overhang the verge. The gauge of the roof is then set and a straight edge up the verge is marked and excess overhanging battens are cut off. A small cut is made just behind the water check or drip 2 to allow a neat join onto the facia board (eaves). The device of the invention is then slid over the end of the battens and, after ensuring it is straight and true, it is then nailed into position using non-ferrous nails 6. Any uneven brick cuts can be sealed using mastic sealant 8.

The undercloak one can be simply adjusted in or out to allow for the overhang of the tiles that is caused by size differentials.

The above described device can be designed to fit directly onto standardised 25 mm roofing battens.

The flexible co-extruded rubber strip 2 quickly and easily forms a waterproof seal (water check) but allows for the contour step created at the overlap of the slates.

The above described device provides a simple and slim design which forms a clean edge 3 that is pleasing to look at. Furthermore, the clean drip section prevents rain water from running back under the roof.

Figure 3:
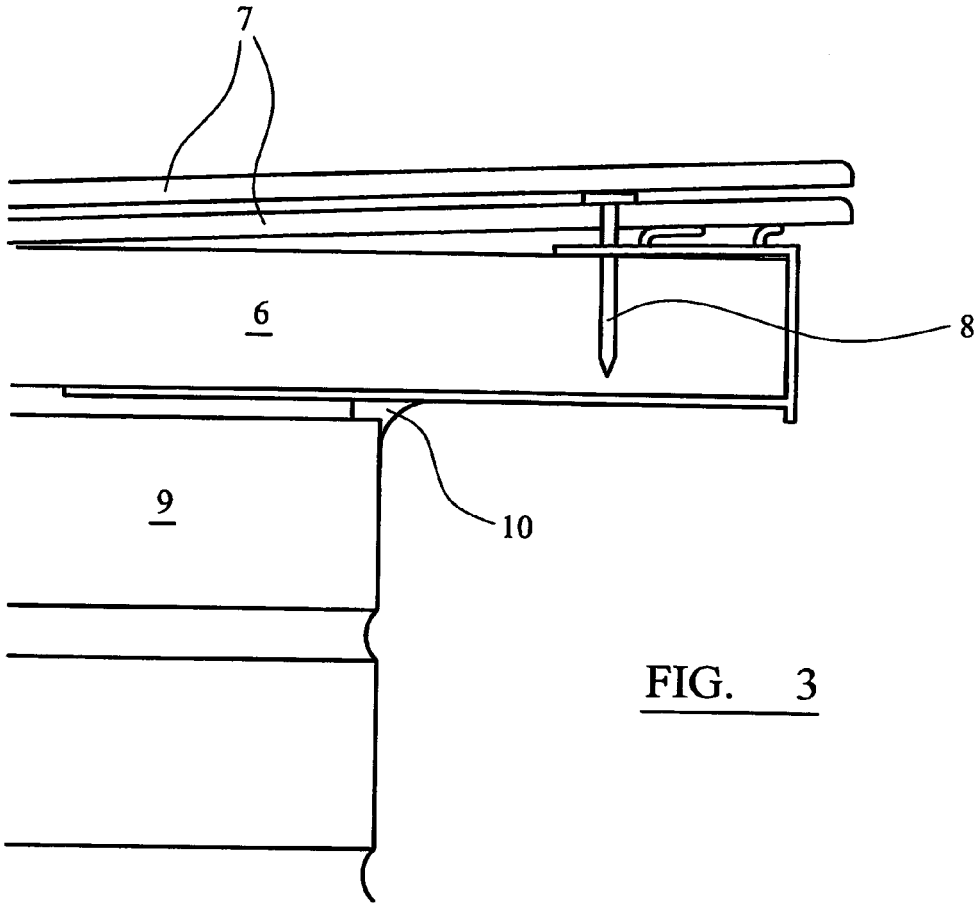
FIG. 3 shows a further roof verge with a slate covering and incorporating a second embodiment of the device of the present invention.
Figure 4:
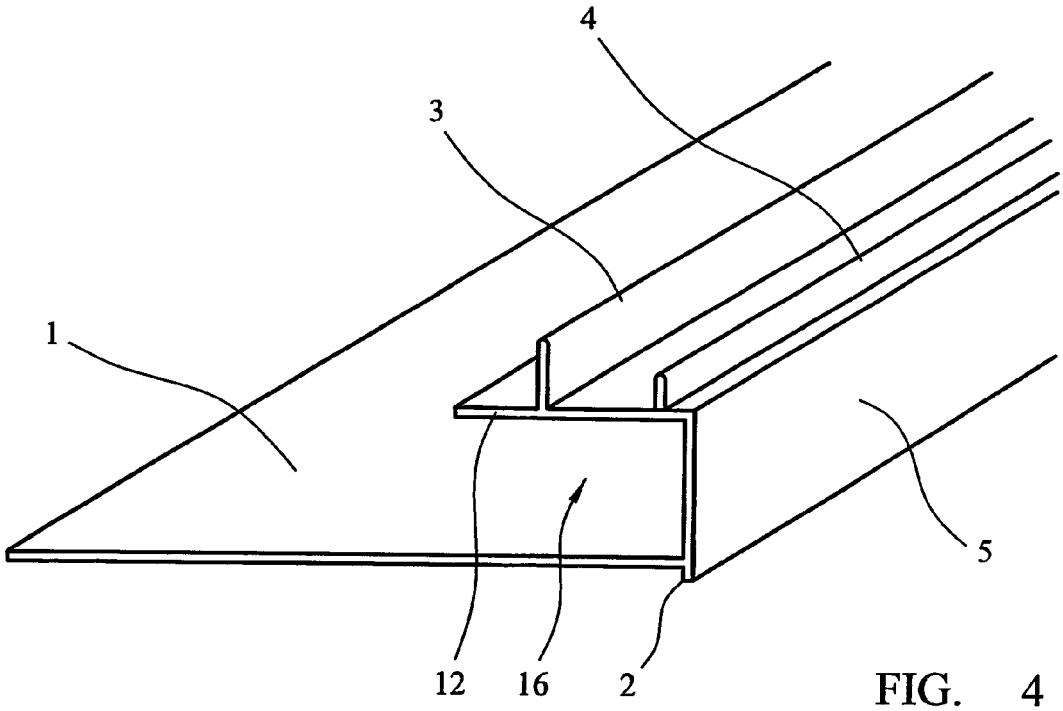
FIG. 4 is a perspective view of the second embodiment of the invention.

Referring now to FIGS. 3 and 4 of the accompanying drawings, a second embodiment of a roof edging device in accordance with the present invention is also for use with a roof verge, in this case a slate covered roof. The device is broadly similar to that described above with reference to FIGS. 1 and 2 and provides a channel section 16 formed from plastics strip 12, verge face 5 and overhang 1. Upstanding from strip 12 are two longitudinal webs 3 and 4. Web 3 is a 10 mm secondary water check made of flexible rubber and web 4 is a 5 mm primary water check also made of flexible rubber.

This embodiment is also a co-extruded PVC strip available in various colours. It can be used with many types of roof covering but is restricted insofar as it will only seal a lap step of up to 10 mm. It is therefore ideal for natural and man-made slates 7. It can be used directly over brickwork 9 or finished timber as well as many other styles and substrates.

In order to fit the device of FIG. 4 to achieve the arrangement shown in FIG. 3, the roof is first felted and battened in the traditional way, allowing the battens 6 to overhang the verge. The gauge of the roof is then set and a straight edge up the verge is marked and excess overhanging battens are cut off. A small cut is made just behind the drip to allow a neat join onto the facia board (eaves). The device is slid over the end of the battens and adjusted until it is straight and true. The slates are laid in the usual way while ensuring that the water checks 3 and 4 bend outwards. The slates are then nailed in position using non-ferrous nails 8.

Uneven brick 9 cuts can be sealed using mastic sealant 10.

The above described features of the first embodiment of the invention also apply to this second embodiment.

Referring to FIG. 4A of the accompanying drawings, a third embodiment of the present invention is very similar to the second embodiment and the same reference numerals have been used to indicate the corresponding features of the device. As shown, the angle between strip 12 and verge face 5 is less than 90°, for instance, an angle of about 80°. This ensures that, with a batten located within channel 16, it is firmly gripped by strip 12.

The upstanding webs 3 and 4 are also angled towards the verge face 5, making an angle of about 60° to the strip 12. As illustrated, webs 3 and 4 each taper slightly from bottom to top. For instance the thickness of the webs 3 and 4 may be about 1.5 mm at the bottom and somewhat less than this at the top with the curved free ends having a radius of 0.5 mm.

The embodiments of this invention, including that illustrated in FIG. 4A may be provided with slots punched through the underside of the device to allow for ventilation to the roof space.

Figure 5:
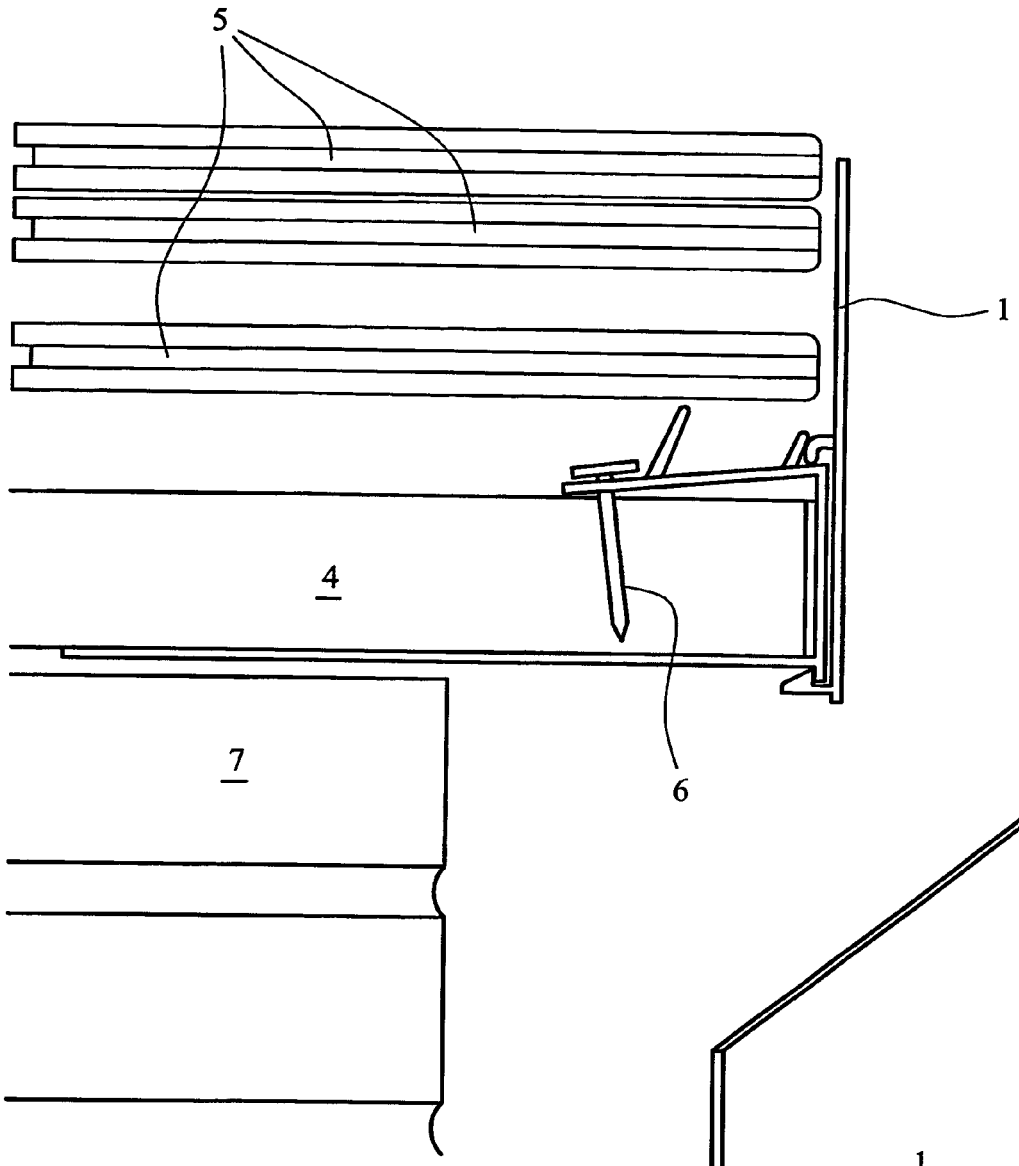
FIG. 5 is a cross-section through a roof verge and incorporating a fourth embodiment of the present invention.
Figure 6:
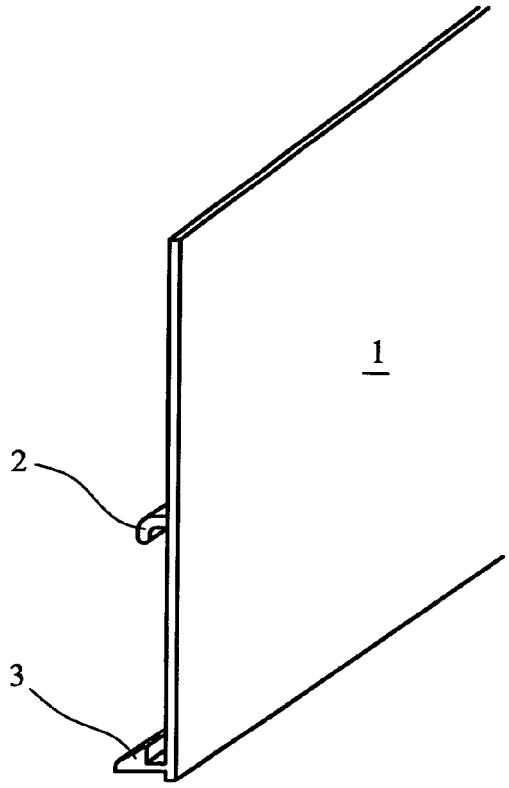
FIG. 6 is a perspective view of the outer face member of the fourth embodiment of the invention.

Referring to FIGS. 5 and 6 of the accompanying drawings, a fourth embodiment of the invention is similar to those described above with reference to FIGS. 3 and 4 and to FIG. 4A of the drawings. In this case however, the nail 6 extends only through the device of the invention and batten 4. This allows for expansion of the various components. An outer face member 1 is clipped to the device of the invention by means of top locating lug 2 and lower snap lug 3.

This two part construction allows the differential expansion, as well as reduced cost and stock requirements.

In order to fit this device, the roof is felted and battened in the traditional way, allowing, the battens to overhang the verge. The gauge of the roof is set and a straight edge is marked at the verge and excess overhanging battens are cut off. A small cut is made just behind the drip to allow a neat join onto the fascia board (eaves). The device of the present invention is then slid over the end of the battens. The top lugs of the face cover 1 are located onto the device and the lower lug 3 is snapped into place. The tiles 5 are laid in the usual way whilst ensuring that the water check is bent outwards and the tiles are nailed in position. Any uneven brick 7 cuts can be sealed using mastic sealant.

Figure 7:
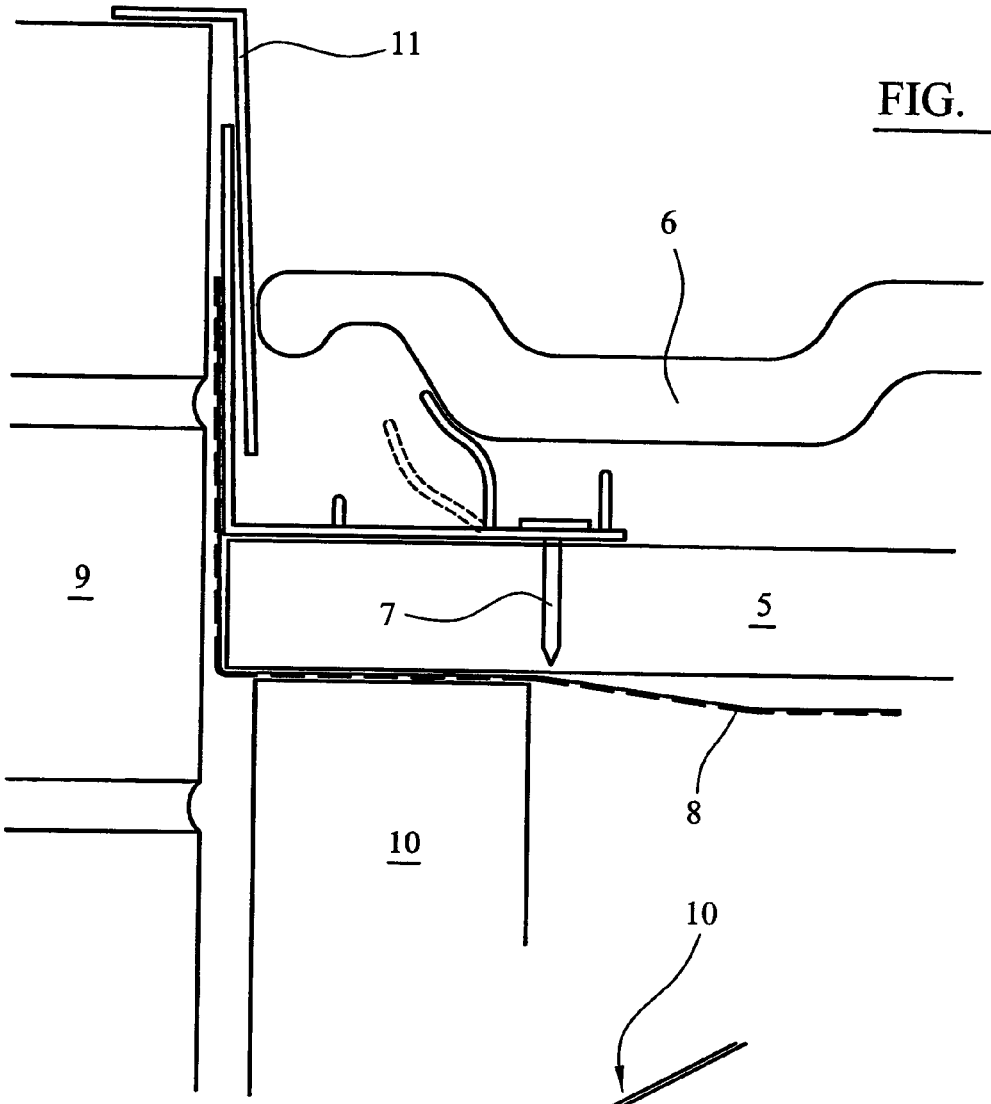
FIG. 7 shows a roof abutment with profiled tiles and incorporating a fifth embodiment of the present invention.
Figure 8:
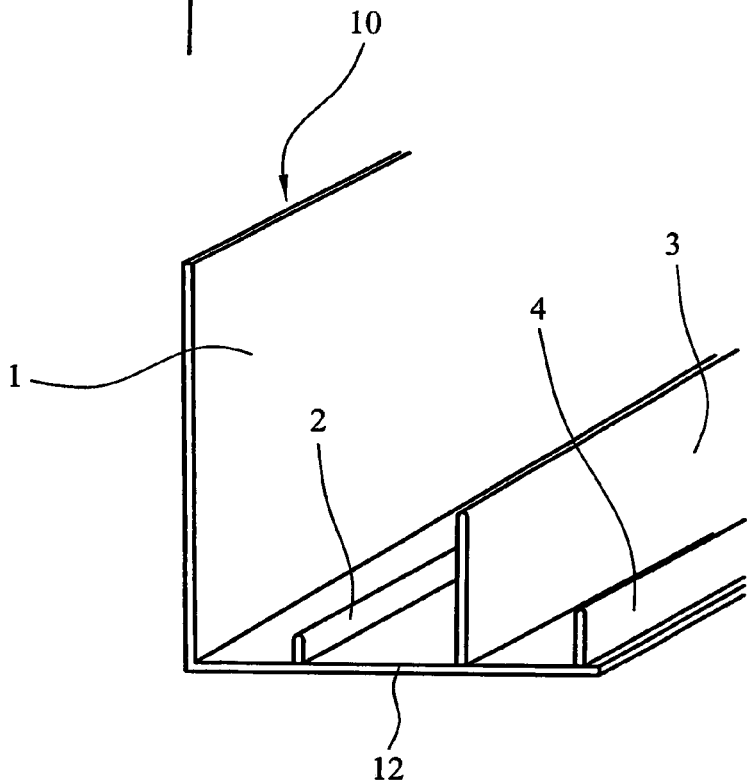
FIG. 8 is a perspective view of the fifth embodiment of the present invention.

Referring now to FIGS. 7 and 8 of the accompanying drawings, a roof edging device 10 is for use at the abutment of a roof. The device is in the form of a co-extruded black coloured PVC strip 12 having a plurality of upstanding webs 1,2,3 and 4. Web or upstand 1 has a height of about 75 mm. Primary water check 2 is made of flexible rubber and has a height of about 5 mm. Secondary water check 3 is also made of flexible rubber and has a height of about 30 mm. Additional water check 4, also flexible rubber, has a height of about 10 mm.

This fifth embodiment of the present invention is designed to be used in the construction industry as a simple and cost-effective water seal when the roof abuts a wall. It can be used with many types of roof covering but is restricted to the extent that, because it has a large water check 3, it will only seal a lap step of profiled tiles above 10 mm. The profile of such tiles varies and the requirement of the water check can change because of the lap step (shown in dotted lines in FIG. 5). It is therefore ideal for profiled and plain tiles 6.

In order to fit the device 10 to achieve the arrangement shown in FIG. 7, the roof is first felted and battened, using battens 5, in the traditional way allowing the roofing membrane 8 to stand up the wall by 75 mm. The device is then fitted on top of the batten with the upstand 1 against the wall. The top 75 mm of the water check is cut and removed to allow for the device to be lapped over a mastic seal. The lead flashing 11 is then cut and dressed.

If appropriate, the nib at the top of the tile is removed and the tile is then fitted in the usual way, ensuring that the water checks 2,3 and 4 are bent outwards. The tiles are then nailed in position using non-ferrous nails 7.

Where appropriate, a vertical cut is made in water check 3 just above the tile to ensure that the seal comes high enough to meet the underside of the tile that is lapped above.

In FIG. 7 the timber roofing battens are item 5 and the timber rafter is item 10.

The above described embodiment is a quick, cost-effective and simple solution to installing soaker flashing on a profiled and plain tile covered roof. Alternative solutions are in existence but the present invention provides unique flexible co-extruded rubber strips 2,3 and 4 that quickly and easily form a waterproof seal (water check) that allows for the contour step created at the overlap of the slates.

Figure 9:
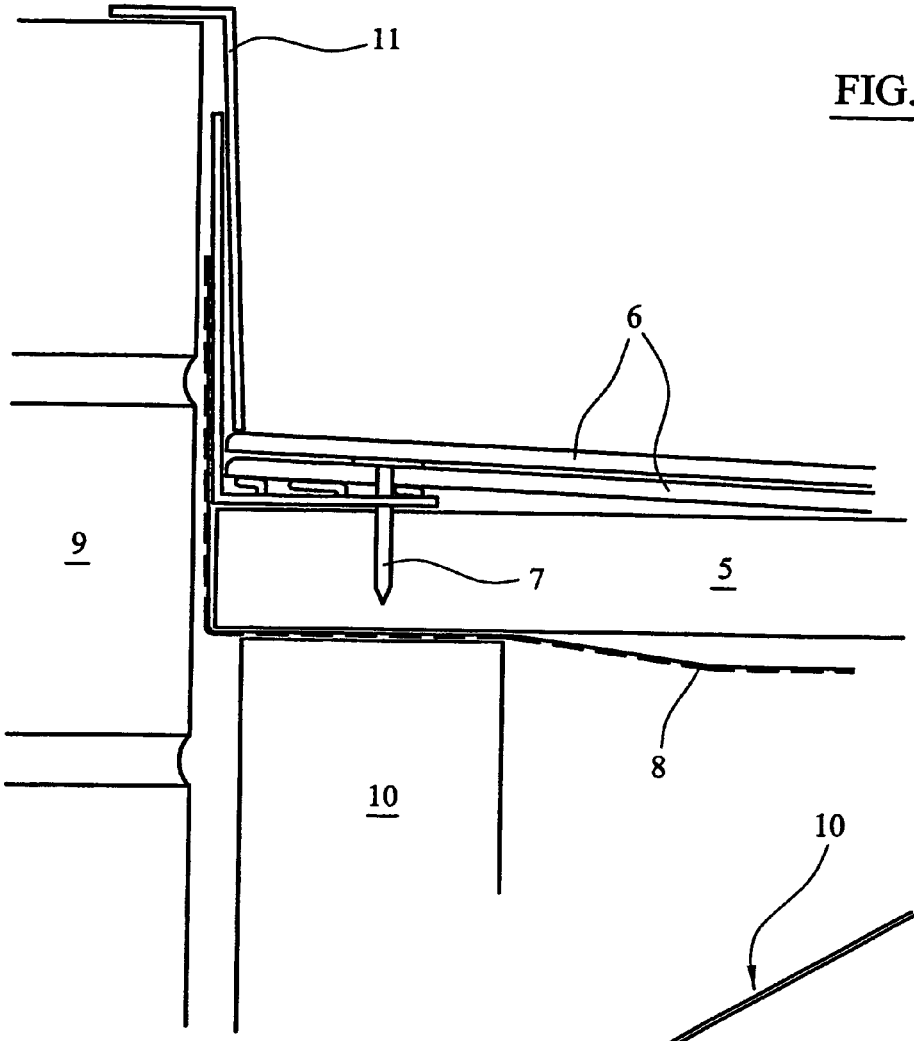
FIG. 9 shows a roof abutment with slate tiles and incorporating a sixth embodiment of the device of the present invention.
Figure 10:
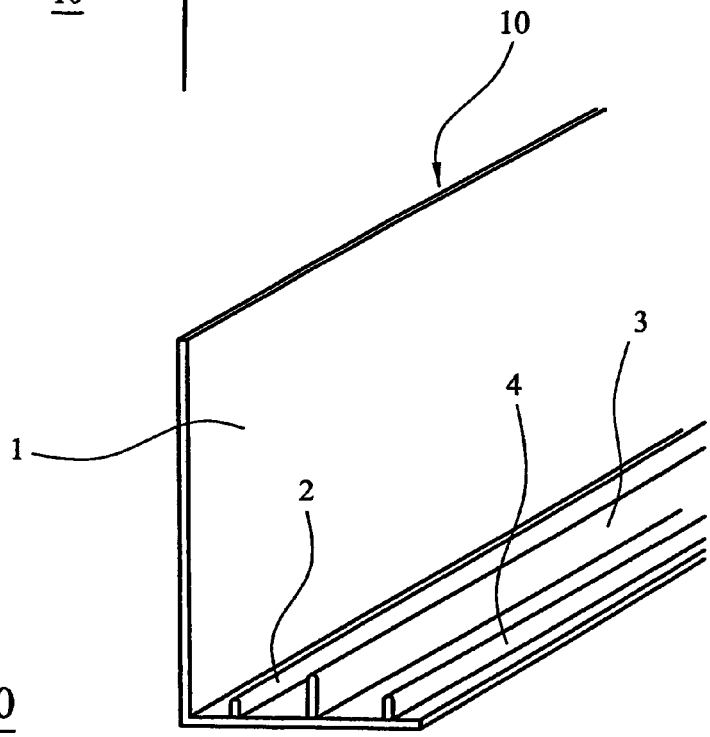
FIG. 10 is a perspective view of the fifth embodiment of the present invention.

Referring to FIGS. 9 and 10 of the accompanying drawings, a sixth embodiment 10 of the present invention is for use at a roof abutment where the roof covering comprises slates 6. Device 10 is a co-extruded black coloured PVC strip which is designed to be used in the construction industry as a simple and cost-effective water seal when the roof abuts a wall. It can be used with many types of roof covering but is restricted to the extent that it will only seal a lap step of up to 10 mm. It is therefore ideal for natural and man-made slates 6.

The device is broadly similar to that described above with reference to FIGS. 5 and 6. Upstand 1 has a height of 75 mm. Primary water check 2 is made of flexible rubber and has a height of 5 mm. Secondary water check 3 is also made of flexible rubber and has a height of 10 mm. Additional water check 4, also of flexible rubber, has a height of 5 mm. In order to incorporate the device into a roof construction as shown in FIG. 7, the roof is first felted and battened, using battens 5, in the traditional way, allowing the roofing membrane 8 to stand up the wall by 75 mm. The device 10 is then fitted on top of the batten with the upstand 1 against the wall. The top 75 mm of the water check is cut and removed to allow for the device to be lapped over a mastic seal.

The lead flashing 11 is cut and dressed.

The slates 6 are laid in the usual way whilst ensuring that the water checks 2,3 and 4 bend outwards. The slates are nailed in position using non-ferrous nails 7.

Referring to FIG. 10A of the accompanying drawings, there is illustrated a seventh embodiment of the invention which is very similar to the fifth embodiment. The same numerals have been used for corresponding features. Upstand 1 is inclined backwardly from a vertical to strip 12. For instance, the angle between upstand 1 and strip 12 is 93°.

Upstand 1 is provided with a groove 19 which is located in its outer (to strip 12) face and which runs parallel to strip 12.

Webs 2, 3 and 4 each extend upwardly and towards upstand 1, making an angle of about 65° to the strip 12. The height of the webs 2, 3 and 4 decrease from 2 to 4.

The free end of strip 12 has a thickness of about 1 mm, compared with the thickness of 1.5 mm for the remainder of strip 12 and upstand 1. The very end of strip 12 is curved with a 1 mm radius.

The invention claimed is:

1. A roof of tiles/slates laid upon battens and including a roof edging device formed in one piece of synthetic plastics material and comprising an upright verge face extending along a verge of the roof and a substantially planar strip located under an edge of the roof adjacent the verge with a first web and a second web upstanding from the strip, each of said webs being resiliently deformable relative to the strip, being bent towards said verge face by engagement with the underneath of the edge of the tiles/slates to form a water resistant seal therewith, and being planar prior to being bent by engagement with the tiles/slates, wherein the second web is further from said verge face than the first web, has a height from the strip which is greater than that of the first web and is bent towards the verge face more than the first web and the seal formed by the second web with the tiles/slates is more water-resistant than the seal formed by the first web with the tiles/slates.

2. A roof as claimed in claim 1, wherein the webs of the roof edging device are coextruded with the strip.

3. A roof as claimed in claim 1, wherein the or each resiliently deformable web extends from a root at the strip to a tip for engagement with the tiles/slates and reduces in thickness from its root towards its tip.

4. A roof as claimed in claim 1, wherein said roof edging device includes a further web which is not resiliently deformable relative to the strip and extends upwards from a side of the strip.

5. A roof as claimed in claim 4, wherein said further web extends downwards from said strip.

6. A roof as claimed in claim 4, wherein said further web is formed with a longitudinal groove along a face of the further web remote from said strip.

7. A roof as claimed in claim 1, wherein the roof edging device includes a channel below the strip for accommodating ends of roofing battens between faces of the channel.

8. A roof as claimed in claim 7, wherein said faces of the channel extend from a closed base and are separated by a distance that reduces away from the base.

9. A roof as claimed in claim 1, wherein at least the first and second webs are inclined to the strip.

10. A method of weatherproofing a roof of tiles/slates, which method comprises providing under an edge of a said tile/slate a roof edging device as claimed in claim 1, locating the strip of the device under an edge of the tiles/slates and engaging the or each resiliently deformable web of the device with an underside of the tiles/slates so that it is resiliently deformed towards said edge forming therewith a primary water check and a secondary water check, the secondary water check being further from said edge than said primary water check, and the secondary water check being more water-resistant than the primary water check.

* * * * *